US007012598B2

(12) United States Patent
Park et al.

(10) Patent No.: US 7,012,598 B2
(45) Date of Patent: Mar. 14, 2006

(54) LIQUID CRYSTAL DISPLAY DEVICE AND METHOD FOR OPERATING THE SAME

(75) Inventors: Jong Jin Park, Seoul (KR); Hyeon Ho Son, Kyonggi-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 323 days.

(21) Appl. No.: 10/329,498

(22) Filed: Dec. 27, 2002

(65) Prior Publication Data

US 2003/0122772 A1 Jul. 3, 2003

(30) Foreign Application Priority Data

Dec. 29, 2001 (KR) ..... P10-2001-0088417

(51) Int. Cl.
*G09G 3/36* (2006.01)

(52) U.S. Cl. ..... 345/204; 345/77; 345/84; 345/87; 345/98; 345/100; 345/102; 348/790; 348/791; 348/797; 349/44; 349/61; 349/69; 315/169.4

(58) Field of Classification Search ..... 345/76, 345/77, 84, 87, 98, 100, 102, 204; 348/790, 348/791, 797; 349/44, 61, 69; 315/169.4
See application file for complete search history.

(56) References Cited

U.S. PATENT DOCUMENTS 5,030,943 A * 7/1991 Anglin ..... 345/102
5,670,980 A * 9/1997 Kuga ..... 345/102
5,708,497 A * 1/1998 Fujieda ..... 356/71
5,940,053 A * 8/1999 Ikeda ..... 345/77
6,049,321 A * 4/2000 Sasaki ..... 345/99
6,072,454 A * 6/2000 Nakai et al. ..... 345/97
6,181,312 B1 * 1/2001 Sekine ..... 345/98
6,693,619 B1 2/2004 Miura et al.
2001/0009411 A1 * 7/2001 Kusanagi ..... 345/93
2003/0197663 A1 * 10/2003 Lee at al. ..... 345/76

FOREIGN PATENT DOCUMENTS

CN 1296255 A 5/2001
JP 2001-125547 5/2001

* cited by examiner

*Primary Examiner*—Ricardo Osorio
*Assistant Examiner*—Vincent E. Kovalick
(74) *Attorney, Agent, or Firm*—Morgan, Lewis & Bockius LLP

(57) ABSTRACT

A method for operating a liquid crystal display having a panel with a back light includes applying a first gate signal starting a real data period followed by a second gate signal starting a black data period sequentially to gate lines of the panel, applying actual picture data signals to data lines of the panel during the real data period and reset data signals to the data lines of the panel during the black data period to drive cells of the panel during a frame along a gate line and controlling a ratio of the real data period to the black data period for a subsequent frame.

17 Claims, 6 Drawing Sheets

LIQUID CRYSTAL DISPLAY DEVICE AND METHOD FOR OPERATING THE SAME

This application claims the benefit of the Korean Application No. P2001-88417 filed in Korea on Dec. 29, 2001, which is hereby incorporated by reference in its entirety.

BACKGROUND OF THE INVENTION

1. Field of the Invention

The present invention relates to a method for operating a liquid crystal display, and more particularly, to a method for operating a liquid crystal display (LCD) to prevent the appearance of blur.

2. Background of the Related Art

In general, an LCD has a system of cells in which a thin film transistor (TFT) is positioned in each cell of the LCD. A large-sized LCD having a large number of cells has been the subject of research because it has a high contrast ratio with a wide and linear gray scale capability for a moving image. Moreover, a large-sized LCD has application to large displays, such as High Definition Television (HDTV) because a large-sized LCD can be fabricated such that all of the cells are operational resulting in a high picture quality.

A related art LCD will be explained, with reference to the attached drawings. FIG. 1 illustrates a block diagram of a related art LCD. The related art LCD shown in FIG. 1 is provided with a Low Voltage Differential Signaling (LVDS) module 1 for receiving a picture data for an LCD panel 2 and providing data enable signals, vertical synchronizing signals, horizontal synchronizing signals and a system clock to a timing controller 3. In addition, the LVDS 1 provides picture data to a memory part 5 of the system. Data signals are provided to a data driving part 8 of the LCD panel 2 and gate signals are provided to a gate driving part 9 of the LCD panel 2 by the timing controller 3 in response to the data enable signals, vertical synchronizing signals, horizontal synchronizing signals and the system clock. The data driving part 8 provides data to the cells 7 of the LCD panel 2 while the gate driving part 9 drives gates of TFTs in the cells 7 of the LCD panel 2 such that cells 7 receive data. The memory part 5 receives the data signals from the timing controller part 3 and also receives picture data from the LVDS 1. The picture data is R, G, and B data. Using the picture data and the data signals, the memory part 5 provides even and odd numbered signals required for driving data in the data driving part 8 of the LCD panel 2.

The LCD panel 2 is provided with a plurality of gate lines 10 and a plurality of data lines 11 formed in a matrix shape that define the cells 7 of the LCD panel 2. Each cell has a TFT (not shown) connected to a pixel electrode. A back light 15 that can be a light conduit type is formed on the backside of the LCD panel 2 for illuminating all of the cells on the back side of the LCD panel 2. The data level or voltage value of the data supplied to the pixel electrode through the TFT determines the amount of light transmittance that will occur through the cell from the back light 15.

FIG. 2 depicts a timing diagram for the related art LCD illustrated in FIG. 1. The timing for the related art LCD shown in FIG. 1 will be explained briefly. Although, in general, the timing of a gate signal, such as a scanning signal, varies with a resolution of the LCD, the timing diagrams for operating the related art LCD will be explained based on five scanning signals to simplify explanation. FIG. 2 illustrates a timing diagram for the related art LCD illustrated in FIG. 1. Referring to FIG. 2, the gate driving part 9 provides gate signals G1, G2, G3, G4 and G5 to the gate lines 10 for turning on the TFTs while the data driving part 8 provides data signals D to data lines 11. More specifically, the gate signals turn on and then turn off each TFT in sequence such that the data signals D are transmitted through the TFTs to the cells of the LCD panel only when the TFTs are turned on. On a screen for displaying an image, all of the gate lines are sequentially scanned such that all of the TFTs for the cells of the LCD panel are turned on and then turned off during one frame.

The related art LCD has a problem in that images of a first frame overlap into a second frame due to the response time of a cell when data for a cell is changed to new data in the next frame since light can still momentarily transmit through the cell. FIG. 3 illustrates the response of a cell changing from one data state to another data state. As shown in FIG. 3, the cell has a first frame If that has a first data level D1. Subsequently, the data in the cell is changed to a second data level D2 during a second frame 2*f*. However, there is a delay in the cell transferring from the first data level D1 to the second data level D2 that causes the appearance of blur on the screen. It is appearance of this blur caused by the delay in a cell transferring from one data level to another data level that impedes the use of an LCD panel as a HDTV.

SUMMARY OF THE INVENTION

Accordingly, the present invention is directed to a method for operating a liquid crystal display (LCD) that substantially obviates one or more of the problems due to limitations and disadvantages of the related art.

An object of the present invention is to provide a method for operating an LCD, which prevents the appearance of blur in an LCD panel.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a method for operating a liquid crystal display having a panel with a back light includes applying a first gate signal starting a real data period followed by a second gate signal starting a black data period sequentially to gate lines of the panel, applying actual picture data signals to data lines of the panel during the real data period and reset data signals to the data lines of the panel during the black data period to drive cells of the panel during a frame along a gate line and controlling a ratio of the real data period to the black data period for a subsequent frame.

In another aspect, a method for operating a liquid crystal display (LCD) having a back light part with a plurality of light emission elements connected to respective power source terminals, the method includes the steps of: providing a gate signal sequentially to a plurality of gate lines such that all the thin film transistors along each gate line are turned on; providing one of a reset data signal and actual picture data signal through each of the turned on thin film transistors; controlling the power source terminals to turn off a light emission element corresponding to a gate line receiving a reset data signal and to turn on a light emission element corresponding to a gate line receiving an actual picture data signal.

In another aspect, a method for operating a liquid crystal display (LCD) panel having a plurality of gate lines and a plurality of data lines that cross each other in which a plurality of light emission elements are in correspondence to the gate lines of the LCD panel, the method includes the steps of: applying a gate signal sequentially to the gate lines; applying a data signal to the data lines synchronized to the gate signal in each frame; controlling a black data period of a subsequent frame based upon a state of a present frame; and turning off the light emission elements corresponding gate lines in a black data period.

In another aspect, a liquid crystal display device includes a panel having a plurality of gate lines running in parallel in one direction and a plurality of data lines running in parallel perpendicular to the gate lines, gate input drivers for providing gate signals to the gate lines, data input drivers for providing data signals to the data lines and a back light unit having a plurality of light emitting elements parallel to the gate lines, wherein at least one of the light emitting elements are turned off for a time interval corresponding to a data signal provided to pixels along at least one gate line corresponding to the at least one light emitting element.

It is to be understood that both the foregoing general description and the following detailed description are exemplary and explanatory, and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Figure 1:
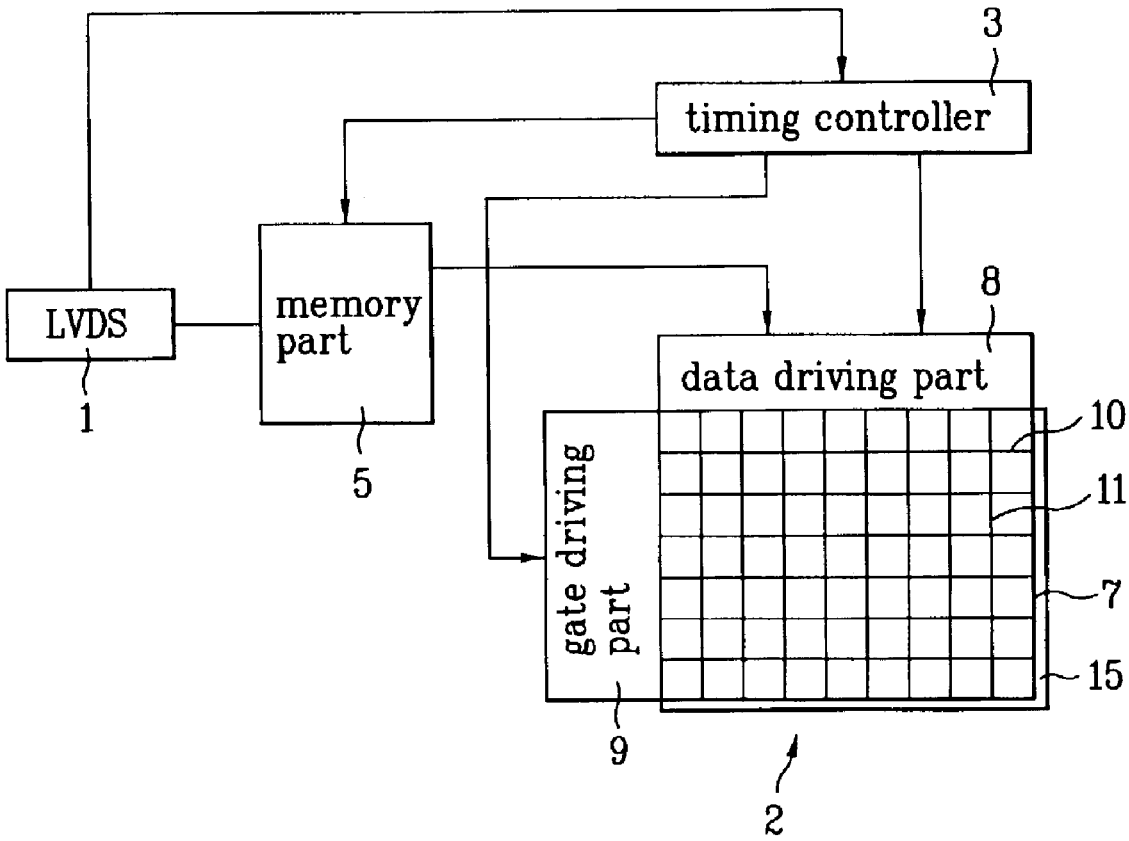
FIG. 1 Related Art
FIG. 1 illustrates a block diagram of a related art LCD.
Figure 2:
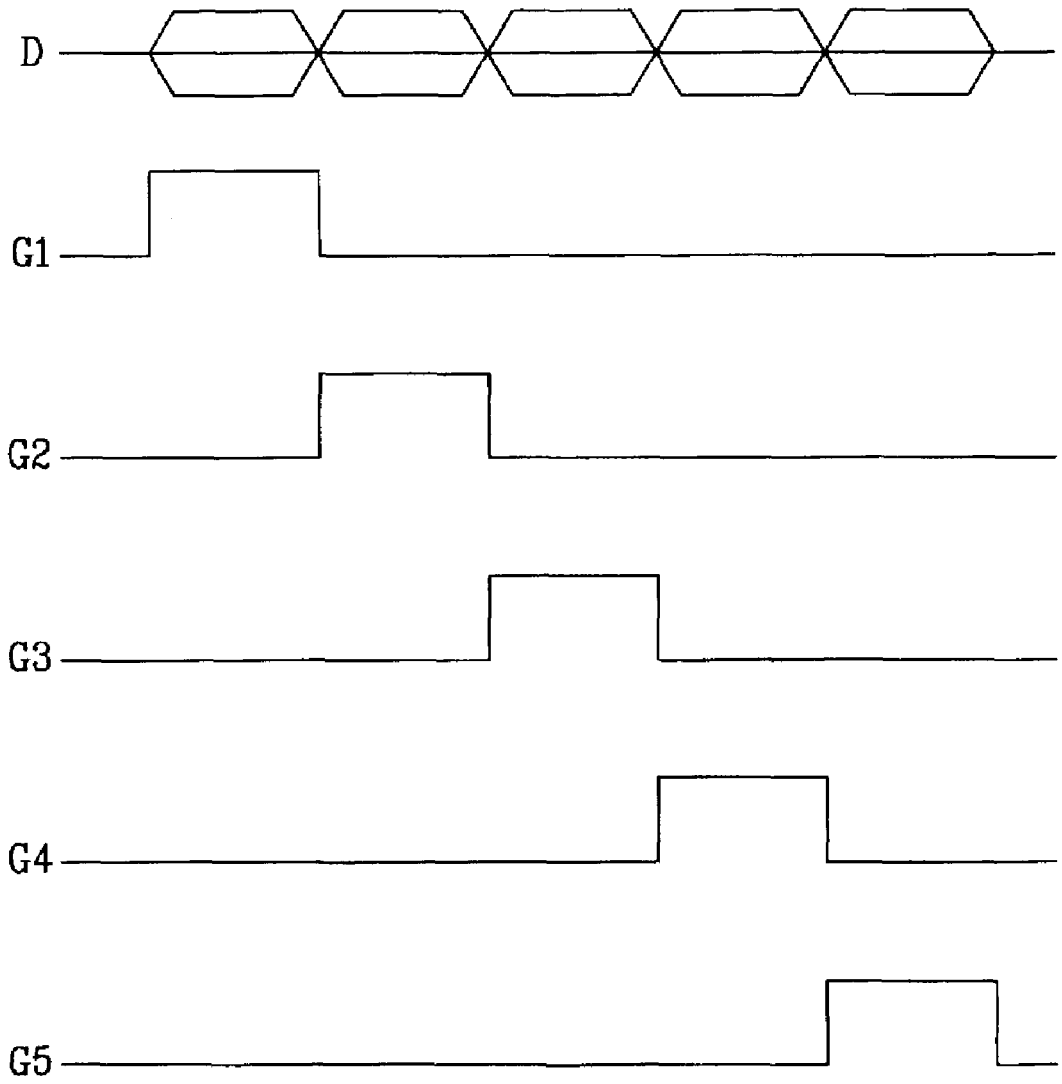
FIG. 2 Related Art
FIG. 2 depicts a timing diagram for the related art LCD illustrated in FIG. 1.
Figure 3:
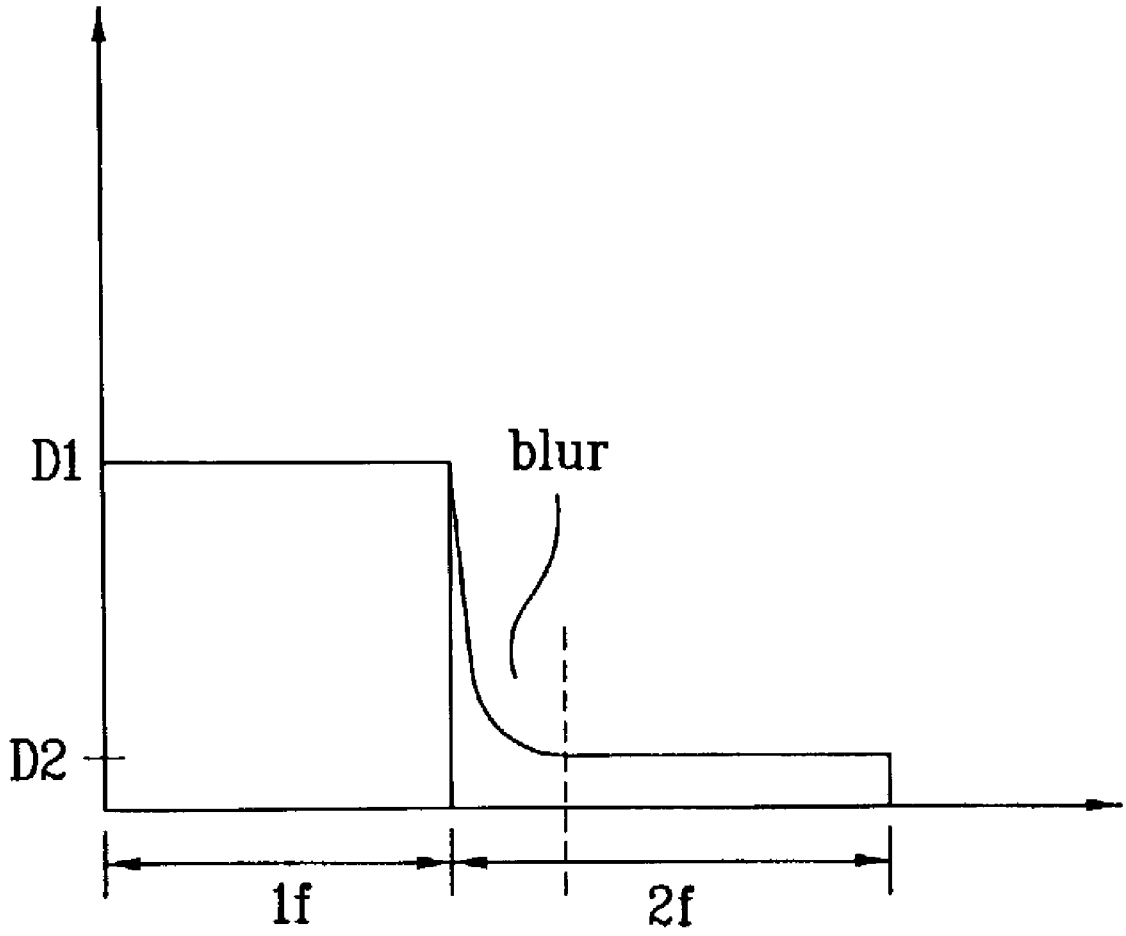
FIG. 3 Related Art
FIG. 3 illustrates the response of a cell changing from one data state to another data state.
Figure 4A:
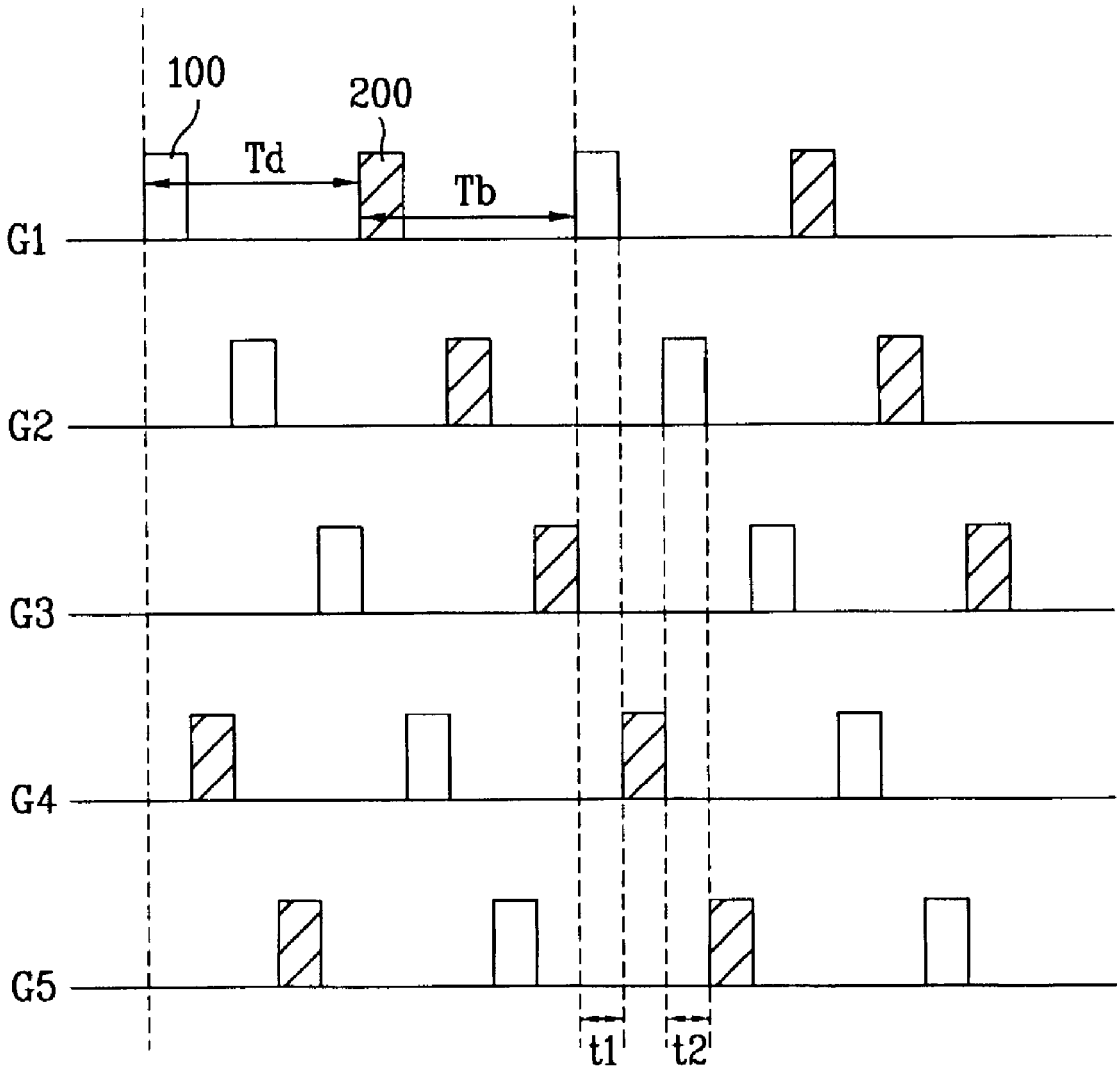
FIG. 4A illustrates a timing diagram for explaining a method for operating an LCD in accordance with a first embodiment of the present invention.

Reference will now be made in detail to the preferred embodiments of the present invention, examples of which are illustrated in the accompanying drawings. FIG. 4A illustrates a timing diagram for explaining a method for operating an LCD in accordance with an embodiment of the present invention. Though not shown in the drawings, the LCD in accordance with an embodiment of the present invention includes a timing controller having control means (not shown) for dividing one frame into a real data period Td, which starts with a first gate signal, and a black data period Tb, which starts with a second gate signal. Thus, the timing controller provides two gate signals to each gate line such that relevant data signals are applied to a gate line during one frame. The timing controller can also adjust a ratio of the real data period Td and the black data period Tb. Further, the method is for a panel having a plurality of gate lines running in parallel in one direction, a plurality of data lines running in parallel perpendicular to the gate lines, gate input drivers each for providing gate signals to the gate lines, data input drivers each for providing data signals to the data lines similar to those described in FIG. 1 of the related art. The present invention further includes a back light unit having a plurality of light emitting elements parallel to the gate lines, wherein at least one of the light emitting elements are turned off for a time interval corresponding to a data signal provide to along at least one gate line corresponding to the at least one light emitting element.

Although the timing of a gate signal, such as a scanning signal, varies with resolution of the LCD panel, the timing diagrams for operating an LCD in accordance with an embodiment of the present invention will be explained based on five scanning signals to simplify explanation. FIG. 4A illustrates a timing diagram for explaining a method for operating an LCD in accordance with an embodiment of the present invention. Referring to FIG. 4A, each of the gate signals G1, G2, G3, G4 and G5 is divided into a first gate signal 100 and a second gate signal 200, wherein the first gate signal 100 starts the real data period Td and the second gate signal 200 starts the black data period Tb. Actual picture data signals are provided to data lines in the real data period Td during the first gate signal and reset data signals are provided to data lines in the black data period Tb during the second gate signal to drive cells of a panel during one frame along a gate line.

As shown in FIG. 4A a first gate signal starting a real data period followed by a second gate signal starting a black data period is applied sequentially to the gate lines of a panel. By adjusting a ratio of the real data period Td to the black data period Tb according to a luminance of the screen, an panel can be operated as an HDTV with reduced blur. The blur can be further reduced turning off the light behind cells of the LCD panel along a gate line that is reset or being reset.

Figure 4B:
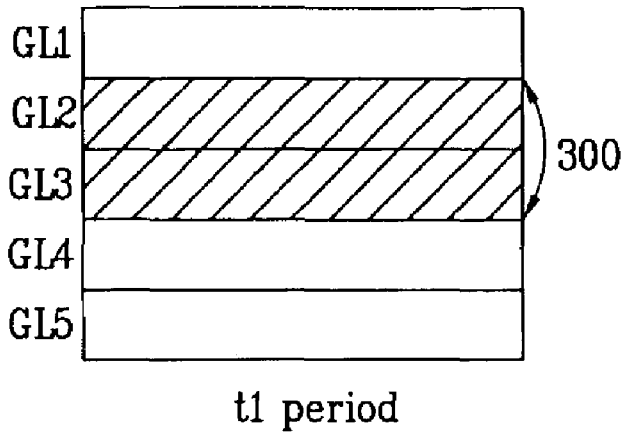
FIG. 4B illustrates the display along gate lines GL1, GL2, GL3, GL4 and GL5 during a time period t1.
Figure 4C:
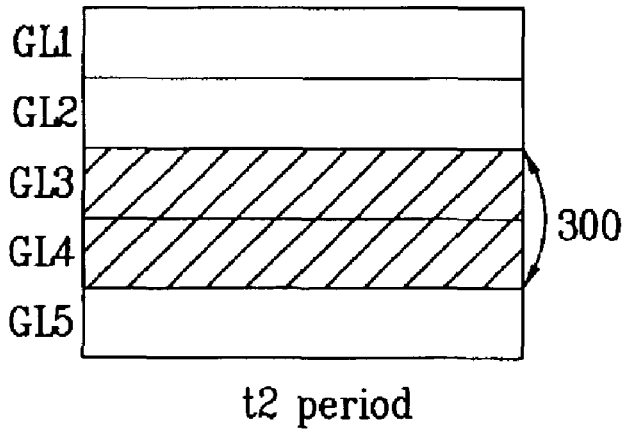
FIG. 4C illustrates the display along gate lines GL1, GL2, GL3, GL4 and GL5 during a time period t2 following the time period t1 in FIG. 4B

A method for operating an LCD in accordance with a first embodiment of the present invention will be explained in reference to FIG. 4B and FIG. 4C. More particularly, FIG. 4B illustrates the display along gate lines GL1, GL2, GL3, GL4 and GL5 during a time period t1 and FIG. 4C illustrates the display along gate lines GL1, GL2, GL3, GL4 and GL5 during a time period t2 following the time period t1 in FIG. 4B. For purposes of discussion, it is assumed that a period of the first gate signal 100 that is provided to a first gate line during a frame is the time period of t1, as shown in FIG. 4A. Further, it is assumed that a period of the first gate signal 100 that is provided to the next gate line after the first gate line during a frame is the time period of t2, as shown in FIG. 4A.

As shown in FIG. 4B, actual picture data is provided and displayed along the first gate line GL1 such that gray scales corresponding to actual picture data signals are displayed, a black state 300 from reset signals is displayed along the second gate line GL2 as a result of a second gate signal 200 from a prior frame, as shown in FIG. 4B. Meanwhile, a black state 300 from reset signals is displayed along the third gate line GL3 as a result of a second gate signal 200 from a prior frame, as shown in FIG. 4B. In addition, actual picture data is displayed along the fourth gate line GL4 as a result of a first gate signal 100 from a prior frame such that gray scales corresponding to actual picture data signals are displayed. Furthermore, actual picture data signals are displayed along the fifth gate line GL5 as a result of a first gate signal 100 from a prior frame such that gray scales corresponding to the actual picture data signals are displayed.

In the next time period t2 as shown in FIG. 4C, actual picture data of the t1 time period is displayed along the first gate line GL1 such that gray scales corresponding to the actual picture data signals are displayed, and actual picture data signals are provided and displayed along the second gate line GL2 as a result of a first gate signal 100 such that gray scales corresponding to the actual picture data signals are displayed. Meanwhile, a black state 300 from reset signals is displayed along the third gate line GL3 as a result of a second gate signal 200 from a prior frame. In addition, a black state 300 from reset data signals is provided and displayed along a fourth gate line GL4 as a result of a second gate signal 200 from the present frame. Furthermore, actual picture data signals are displayed along the fifth gate line GL5 as a result of a first signal 100 from a prior frame such that gray scales corresponding to the actual picture data signals are displayed. As shown in FIGS. 4B and 4C, a position that the at least one of the light emitting elements that is turned off appears to move in a vertical direction as time goes by.

As shown in FIGS. 4A–4C, a first embodiment of the present invention teaches a method for operating a liquid crystal display device having a panel with a back light that includes the steps of applying a first gate signal starting a real data period followed by a second gate signal starting a black data period sequentially to gate lines of the panel, applying actual picture data signals to data lines of the panel during the real data period and reset data signals to the data lines of the panel during the black data period to drive cells of the panel during a frame along a gate line, and controlling a ratio of the real data period to the black data period for a subsequent frame. For example, the black data period Tb of a subsequent frame is increased if the present frame is displaying bright picture data or the black data period Tb of a subsequent frame is decreased if the present frame is displaying dark image data using the control means (not shown) of the timing controller to increase the intensity of an image. More particularly, the controller controls the black data period by controlling the ratio of the real data period Td to the black data period Tb within a frame. Moreover, with regard to the ratio of the real data period Td to the black data period Tb, the black data period Tb can be increased in a subsequent frame if there are significant changes in image data at a high speed in previous frame and can be decreased if there are not significant changes in image data at a high speed in previous frame to reduce motion blur.

By controlling the duration of the black data according to prior frame information, not only on luminance of the picture data but also on a speed of motion that is determined based the degree of change over a few frames, the intensity of an image can be increased and motion blur can be controlled. As the motion of an image on an LCD panel becomes faster, the appearance of motion blur becomes greater. However, an increased black data period TB prevents the appearance of the motion blur. As the motion of an image on an LCD panel slows, the appearance motion blur decreases and thus the duration of the black data period TB can be decreased for an increase in the intensity of the image.

In general, the back light of a related art LCD employs a back light having a light guide plate in which light from light emission elements at edges of the LCD panel is transmitted to the backside of the LCD panel via a light guide plate. The light from a light element at the edge of the LCD panel is reflected through a region of the LCD panel that is adjacent to the edge of the LCD panel where the light element is positioned. However, the back light having the light guide plate projects the same amount of light to the same region of the LCD panel, regardless of the luminance for the image on the panel. In other words, even if the image for the region of the LCD panel is dark, the same amount of light is provided to the region. Thus, the light efficiency or light usage for a dark image data or dark regions of an image on an LCD panel using a back light having the light guide plate is poor.

In a second embodiment of the present invention, an LCD is provided that has plate line type of back light in which regions of the LCD panel that are in a black data period can be turned off for controlling appearance of motion blur and contrast. There is no use for the light from the back light for a cell of the LCD panel in the black data period, since light from the back light which illuminates through the cell from the backside of an LCD panel is blocked or absorbed. Accordingly, the energy used to generate the light is wasted or causes excessive heat that effects the performance of the liquid crystal. Furthermore, a slight amount of light leakage can occur through a cell that is supposed to be reset or turned off, which can cause an appearance of blur. Therefore, turning off light emitting elements during a reset period increases energy efficiency, prevents a build-up of heat and reduces the appearance of blur.

Figure 5:
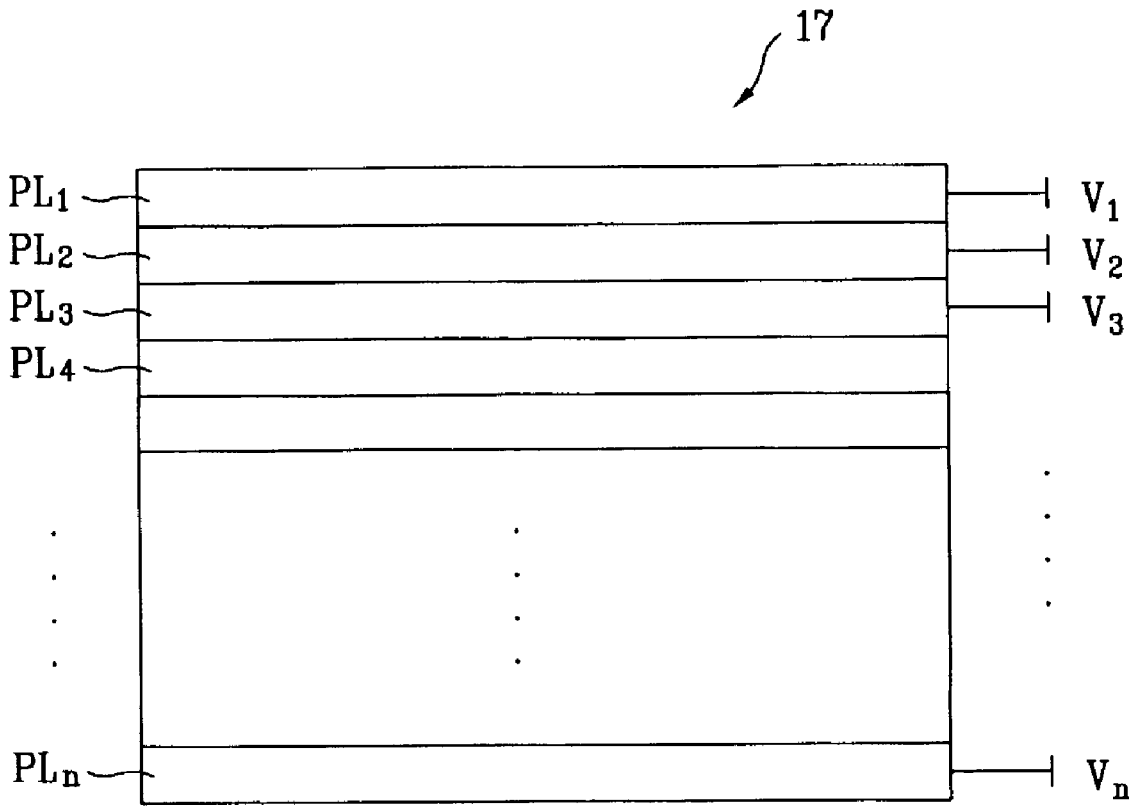
FIG. 5 is front view of a back light having plate line type lights for an LCD panel using a method for operating an LCD in accordance with a second embodiment of the present invention.

FIG. 5 is front view of a back light having plate line type lights for an LCD panel using a method for operating an LCD in accordance with an embodiment of the present invention. As shown in FIG. 5, a back light 17 includes several plate line type lights PL1–PLn arranged on the backside of the LCD panel (not shown) as a light plate. The plate line type lights PL run in the same direction as the gate lines that run across the LCD panel (not shown) from the gate driving part (not shown). If a black data period Tb is occurring in a region of an LCD panel 16 along a gate line or gate lines, a corresponding individual plate line type light or corresponding group of plate line type lights corresponding to the region of the gate line or gate lines are turned off.

The second embodiment of the present invention includes a panel having a plurality of gate lines running in parallel in one direction, a plurality of data lines running in parallel perpendicular to the gate lines, gate input drivers for providing gate signals to the gate lines, data input drivers each for providing data signals to the data lines and a back light unit having a plurality of light emitting elements parallel to the gate lines, wherein at least one of the light emitting elements are turned off by power source terminals. Also, the second embodiment of the present invention includes a method for operating a liquid crystal display, as described above, including the steps of applying a gate signal to the gate lines and applying a data signal to the data lines synchronized to the gate signal and turning off at least one of the light emitting elements that is in a black data period.

Referring to FIG. 5, the plate line type lights are turned off and on at power source terminals V1~Vn at the side of the back light 17. By controlling the power at the power source terminals V1~Vn to turn on and off the appropriate plate line type lights PL, the darkness for a black data period Tb along a gate line, a set of gate lines or sets of gate lines can be increased. Although a plate line type light or a set of plate line lights in a region will be turned off in accordance with a black data period Tb of a gate line or gate lines in the region, the actual image will not have dark lines or regions because of the residual luminescence of liquid crystal cells resulting from a previous exposure to light. The control of a plate line type light can be dependent upon the signal applied to pixels along a corresponding gate line of the plate line type light or the signals that were applied to pixels along the corresponding gate line of the plate line type light.

A gate signal is sequentially applied to a plurality of gate lines such that all the thin film transistors along each gate line are turned on. While the thin film transistors are turned on, one of a reset data signal and actual picture data signal are passed through each of the turned on thin film transistors along a gate line. The data signals are synchronized to the gate signals for each respective gate line. If the data signal is a reset signal, no power is delivered to the power source terminals such that the plate line light corresponding to the gate line is turned off. If the data signal is an actual picture signal, power is delivered to the power source terminals such that the plate line light corresponding to the gate line is turned on.

The length of the black data period is controlled, which effects control of the plate line lights. For example, a black data period can be reduced for a subsequent frame if a present frame has a relatively bright picture data or if prior frames have a relatively slow picture speed to maintain the intensity of the display. Accordingly, the number of the turned off light emission elements is reduced if the black data period is reduced, since the shorter black data period results in less plate line lines concurrently being in a black data period. In the alternative, a black data period can be increased for a subsequent frame if a present frame has a relatively dark picture data or to maintain the contrast of the display. In addition, a black data period can be increased for a subsequent frame if prior frames have a relatively fast picture speed to prevent blur. Accordingly, the number of the turned off light emission elements is increased if the black data period is increased, since the longer black data period results in more plate line lines concurrently being in a black data period.

By controlling the duration of the black data period according to a speed of motion that is determined based on the degree of change over a few frames and increasing the darkness during a black data period, motion blur can be controlled. Accordingly, motion blur of a motion picture can be prevented, providing a motion picture capability equivalent to a cathode ray tube (CRT) type display. Thus, a high definition LCD can be implemented as a HDTV.

It will be apparent to those skilled in the art that various modifications and variations can be made in the method for operating a liquid crystal display (LCD) of the present invention without departing from the spirit or scope of the invention. Thus, it is intended that the present invention cover the modifications and variations of this invention provided they come within the scope of the appended claims and their equivalents.

What is claimed is:

1. A method for operating a liquid crystal display having a panel with a back light comprising the steps of:

applying a first gate signal starting a real data period followed by a second gate signal starting a black data period sequentially to gate lines of the panel;

applying actual picture data signals to data lines of the panel during the real data period and reset data signals to the data lines of the panel during the black data period to drive cells of the panel during a frame along a gate line; and controlling a ratio of the real data period to the black data period for a subsequent frame.

2. The method according to claim 1, wherein the step of controlling the ratio includes the step of:

decreasing the black data period of a next frame, if a present frame has a bright picture data.

3. The method according to claim 1, wherein the step of controlling the ratio includes the step of:

increasing the black data period of a next frame, if a present frame has a dark picture data.

4. The method according to claim 1, wherein the step of controlling a ratio includes the step of:

increasing the black data period of a next frame, if prior frames have a fast picture speed.

5. The method according to claim 1, wherein the step of controlling a ratio includes the step of:

decreasing the black data period of the next frame, if prior frames have a slow picture speed.

6. A method for operating a liquid crystal display (LCD) having a back light part with a plurality of light emission elements connected to respective power source terminals, the method comprising the steps of:

providing a gate signal sequentially to a plurality of gate lines such that all the thin film transistors along each gate line are turned on;

providing one of a reset data signal and actual picture data signal through each of the turned on thin film transistors;

controlling the power source terminals to turn off a light emission element corresponding to a gate line receiving a reset data signal and to turn on a light emission element corresponding to a gate line receiving an actual picture data signal.

7. A method for operating a liquid crystal display (LCD) panel having a plurality of gate lines and a plurality of data lines that cross each other in which a plurality of light emission elements are in correspondence to the gate lines of the LCD panel, the method comprising the steps of:

applying a gate signal sequentially to the gate lines;

applying a data signal to the data lines synchronized to the gate signal in each frame;

controlling a black data period of a subsequent frame based upon a state of a present frame; and turning off the light emission elements corresponding gate lines in a black data period.

8. The method according to claim 7, wherein the black data period is reduced in a subsequent frame if a present frame has a relatively bright picture data.

9. The method according to claim 7, wherein the black data period is increased in the next frame if the present frame has a relatively dark picture data.

10. The method according to claim 7, wherein a number of the turned off light emission elements is reduced if the black data period is reduced.

11. The method according to claim 7, wherein a number of the turned off light emission elements is increased if the black data period is increased.

12. The method according to claim 7, wherein the black data period is increased in a subsequent frame if prior frames have a relatively fast picture speed.

13. The method according to claim 7, wherein the black data period is reduced in a subsequent frame if prior frames have a relatively slow picture speed.

14. The method according to claim 7, wherein a number of the turned off light emission elements is reduced if the black data period is reduced.

15. The method according to claim 7, wherein a number of the turned off light emission elements is increased if the black data period is increased.

16. A liquid crystal display device comprising:

a panel having a plurality of gate lines running in parallel in one direction and a plurality of data lines running in parallel perpendicular to the gate lines;

gate input drivers for providing gate signals to the gate lines;

data input drivers for providing data signals to the data lines; and a back light unit having a plurality of light emitting elements parallel to the gate lines, wherein at least one of the light emitting elements are turned off for a time interval corresponding to a data signal provided to pixels along at least one gate line corresponding to the at least one light emitting element.

17. The device according to claim 16, a position that the at least one of the light emitting elements that is turned off appears to move in a vertical direction as time goes by.

* * * * *

UNITED STATES PATENT AND TRADEMARK OFFICE

CERTIFICATE OF CORRECTION

PATENT NO. : 7,012,598 B2
APPLICATION NO. : 10/329498
DATED : March 14, 2006
INVENTOR(S) : Jong Jin Park et al.

It is certified that error appears in the above-identified patent and that said Letters Patent is hereby corrected as shown below:

Column 5, line 33, “increased” should read -- decreased --; and
line 35, “decreased” should read -- increased --.

Signed and Sealed this

Eleventh Day of July, 2006

JON W. DUDAS
*Director of the United States Patent and Trademark Office*